US008189014B1

(12) United States Patent
Tam et al.

(10) Patent No.: US 8,189,014 B1
(45) Date of Patent: May 29, 2012

(54) GENERATING A SCREEN LAYOUT FOR A BIOS DISPLAY

(75) Inventors: Wai Hong Tam, Taipei (TW); William F. Richardson, Santa Clara, CA (US); Randall R. Spangler, San Jose, CA (US)

(73) Assignee: Google Inc., Mountain View, CA (US)

( * ) Notice: Subject to any disclaimer, the term of this patent is extended or adjusted under 35 U.S.C. 154(b) by 0 days.

(21) Appl. No.: 13/245,740

(22) Filed: Sep. 26, 2011

Related U.S. Application Data

(63) Continuation of application No. 13/211,156, filed on Aug. 16, 2011.

(51) Int. Cl.
*G09G 5/00* (2006.01)

(52) U.S. Cl. ..... 345/629; 345/637

(58) Field of Classification Search ..... 345/629, 345/637; 707/204; 713/2
See application file for complete search history.

(56) References Cited

U.S. PATENT DOCUMENTS

2009/0300057 A1* 12/2009 Friedman ..... 707/204
2010/0325409 A1* 12/2010 Kim et al. ..... 713/2

OTHER PUBLICATIONS

"Issue 10599: Define the bitmap format on ARM and new x86", Chromium OS—the open source project behind Google Chrome OS, retrieved from < http://code.google.com/p/chromium-os/issues/detail?id=10599>, Dec. 27, 2010.

"Issue 10949: Need a GUI tool to edit/generate bitmap blocks", Chromium OS—the open source project behind Google Chrome OS, retrieved from <http://code.google.com/p/chromium-os/issues/detail?id=10949>, Jan. 13, 2011.

"Issue 11017: Implement bmpblk_utility tool to create a new BMPBLOCK", Chromium OS—the open source project behind Google Chrome OS, retrieved from <http://code.google.com/p/chromium-os/issues/detail?id=11017>, Jan. 17, 2011.

"Issue 11766: bmpblk_utility should ensure that yaml files are correct in every possible way", Chromium OS—the open source project behind Google Chrome OS, retrieved from <http://code.google.com/p/chromium-os/issues/detail?id=11766>, Feb. 7, 2011.

"Issue 1494: XScreenSaver work with local_account and new login manager", Chromium OS—the open source project behind Google Chrome OS, retrieved from < http://code.google.com/p/chromium-os/issues/detail?id=1494>, Feb. 5, 2010.

* cited by examiner

*Primary Examiner* — Chante Harrison
(74) *Attorney, Agent, or Firm* — McDermott Will & Emery LLP

(57) ABSTRACT

A system and machine-implemented method for generating a screen layout for a BIOS display on a computing system, via accessing a screen layout definition, wherein the screen layout definition identifies which of a plurality of stored images are to be included in a screen layout, defines an order for overlaying the identified images, and defines a position for placing each identified image within the screen layout; and processing the screen layout definition to generate the screen layout, using the order for overlaying the identified images and the position for placing each identified image as defined in the screen layout definition, for the BIOS display.

19 Claims, 6 Drawing Sheets

GENERATING A SCREEN LAYOUT FOR A BIOS DISPLAY

CROSS REFERENCE TO RELATED APPLICATIONS

The present application is a continuation of and claims the benefit of priority under 35 U.S.C. §120 from U.S. patent application Ser. No. 13/211,156 entitled "Generating a Screen Layout for a Bios Display", filed on Aug. 16, 2011, the disclosure of which is hereby incorporated by reference in its entirety for all purposes.

BACKGROUND

The subject disclosure generally relates to displaying screens in a computer system, and, in particular, to generating a screen layout for a BIOS display.

The Basic Input/Output System (BIOS) is a program that is loaded by a computer during initial startup. The BIOS establishes the basic interfaces for the computer processor and enables the processor to bootstrap an operating system. After an operating system is running, application programs may be loaded and run. The BIOS is typically stored in nonvolatile read-only memory (ROM).

During system bootup, the BIOS may display different screens to a user. For example, when the operating system is unable to boot, the BIOS can display one of several screens to indicate the cause of the failure. Each screen is typically saved as a separate image file, which can be large. Thus, a more efficient manner for displaying screens by a BIOS may be desirable.

SUMMARY

The disclosed subject matter relates to a machine-implemented method for generating a screen layout for a BIOS display on a computing system, via accessing a screen layout definition, wherein the screen layout definition identifies which of a plurality of stored images are to be included in a screen layout, defines an order for overlaying the identified images, and defines a position for placing each identified image within the screen layout; and processing the screen layout definition to generate the screen layout, using the order for overlaying the identified images and the position for placing each identified image as defined in the screen layout definition, for the BIOS display.

The disclosed subject matter also relates to a system for generating a screen layout for a BIOS display on a computing system, the system comprising one or more processors; and a machine-readable medium comprising instructions stored therein, which when executed by the processors, cause the processors to perform operations comprising accessing a data structure which stores a screen layout definition and a plurality of images, wherein the screen layout definition identifies which of the plurality of images are to be included in a screen layout, defines an order for overlaying the identified images, and defines a position for placing each identified image within the screen layout; and processing the screen layout definition to generate the screen layout, using the order for overlaying the identified images and the position for placing each identified image as defined in the screen layout definition, for the BIOS display.

The disclosed subject matter also relates to a machine-readable medium comprising instructions stored therein, which when executed by a machine, cause the machine to perform operations comprising accessing a data structure which stores a plurality of screen layout definitions and a plurality of images, wherein each screen layout definition identifies which of the plurality of images are to be included in a corresponding screen layout, defines an order for overlaying the identified images, and defines a position for placing each identified image within the screen layout, and wherein the data structure stores the plurality of images as separate image blocks, each image block comprising one of the plurality of images and a corresponding image header defining attributes of the one image; selecting one of the plurality of screen layout definitions to apply, based on a state of a bootstrap process of the machine; and processing the screen layout definition to generate the screen layout, using the order for overlaying the identified images and the position for placing each identified image as defined in the screen layout definition, for a BIOS display.

It is understood that other configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

BRIEF DESCRIPTION OF THE DRAWINGS

Certain features of the subject technology are set forth in the appended claims. However, for purpose of explanation, several embodiments of the subject technology are set forth in the following figures.

DETAILED DESCRIPTION

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and may be practiced without these specific details. In some instances, well-known structures and components are shown in block diagram form in order to avoid obscuring the concepts of the subject technology.

Figure 1A:
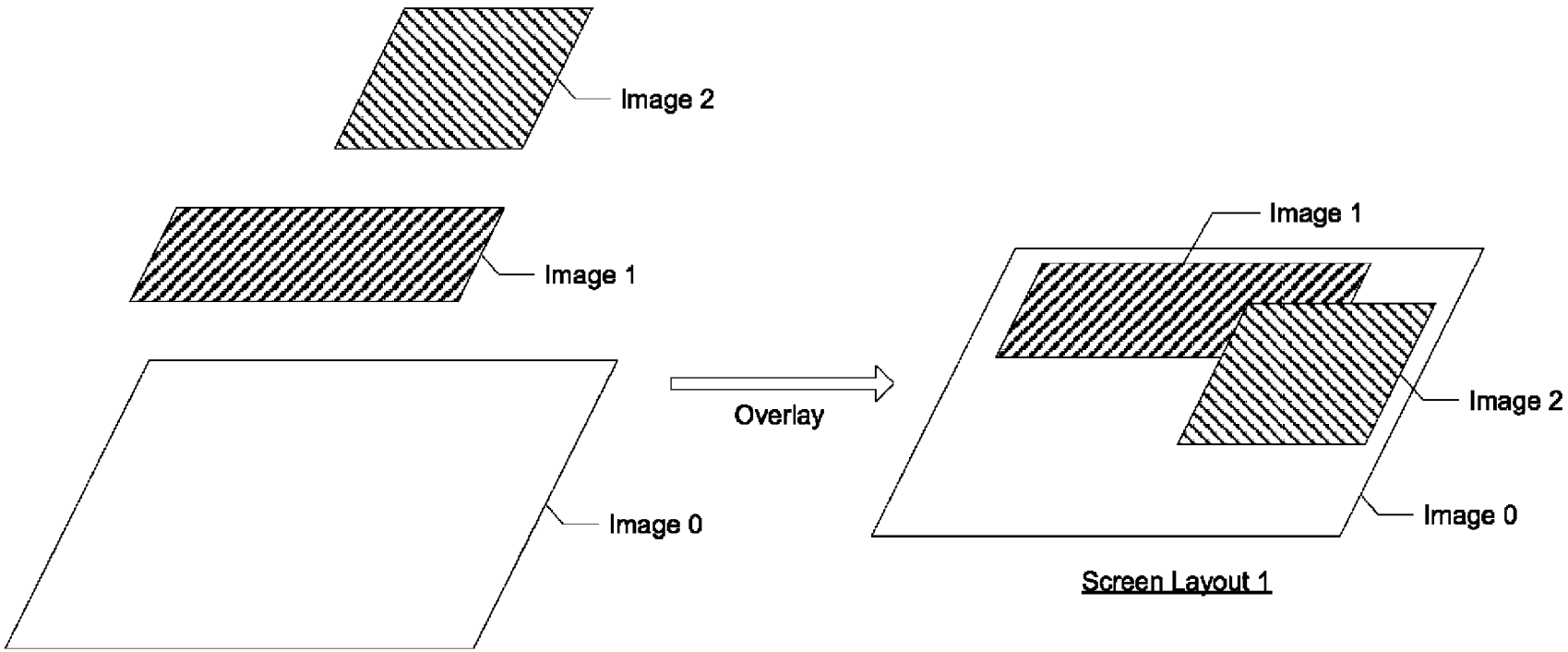
FIGS. 1A and 1B illustrate examples of overlaying images on one another to generate a screen layout in a BIOS display.
Figure 1B:
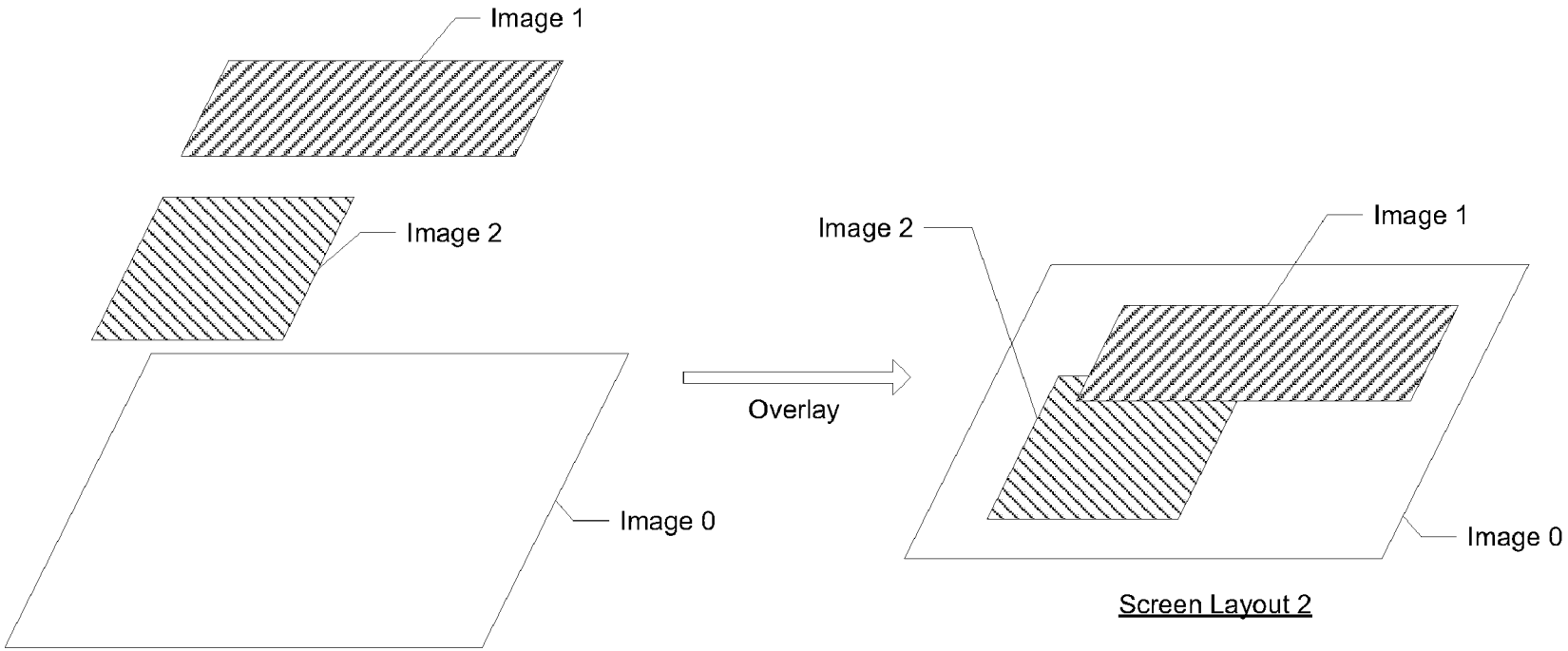

FIGS. 1A and 1B illustrate examples of overlaying images on one another to generate a screen layout in a BIOS display. These diagrams illustrate that images from separate files can be combined to form a single screen image.

As noted above, during the boot up of an operating system, the BIOS may display different screens to a user. Each of these screens can include several graphical components, including messages and symbols indicating a state of the bootstrap process. In conventional systems, each screen is typically saved as a separate image file. Since these screens differ only slightly in some cases, saving the entirety of each screen as a separate file can result in large image files with redundant image data.

To address the foregoing, portions of an overall screen image can be saved as separate image files. These separate image files can be reusable, and can be combined to form a single screen image. By varying use of the separate images, the screens can be varied. The separate images can correspond to large portions of a screen layout (e.g., base images), messages for display (e.g., URLs, model numbers, text instructions), icons for display, other graphical elements for display, or any portion or combination of the foregoing.

The example of FIGS. 1A and 1B illustrates that two different screens, namely screen layout 1 and screen layout 2, can be generated by combining image 0, image 1 and image 2 in different manners. To combine these images, both an order for overlaying the images and a position for each image is employed.

In the example of FIG. 1A, the order for overlaying images is to display image 0, overlay image 1 onto image 0, and overlay image 2 to produce the resulting image. Furthermore, position information for each of images 0 to 2 can be provided (e.g., as x and y-coordinates), so that each image appears in the correct place for screen layout 1. In the example of FIG. 1B, the order of overlaying differs, by displaying image 0, overlaying image 2 onto image 0, and overlaying image 1 on the resulting image. In addition, the positional information for each of images 0 to 2 in FIG. 1B can differ from that in FIG. 1A.

As such, by using smaller image files which represent portions of a screen layout, it is possible to generate different screen layouts, and to reduce the amount of disk space needed to save various screens. For each possible screen layout, a screen layout definition can be provided to identify which of the separate images to use, the order to overlay those images, and the position of each image within the screen. An example of how the screen layout definition is implemented will be described in greater detail below, with reference to FIG. 2.

Figure 2:
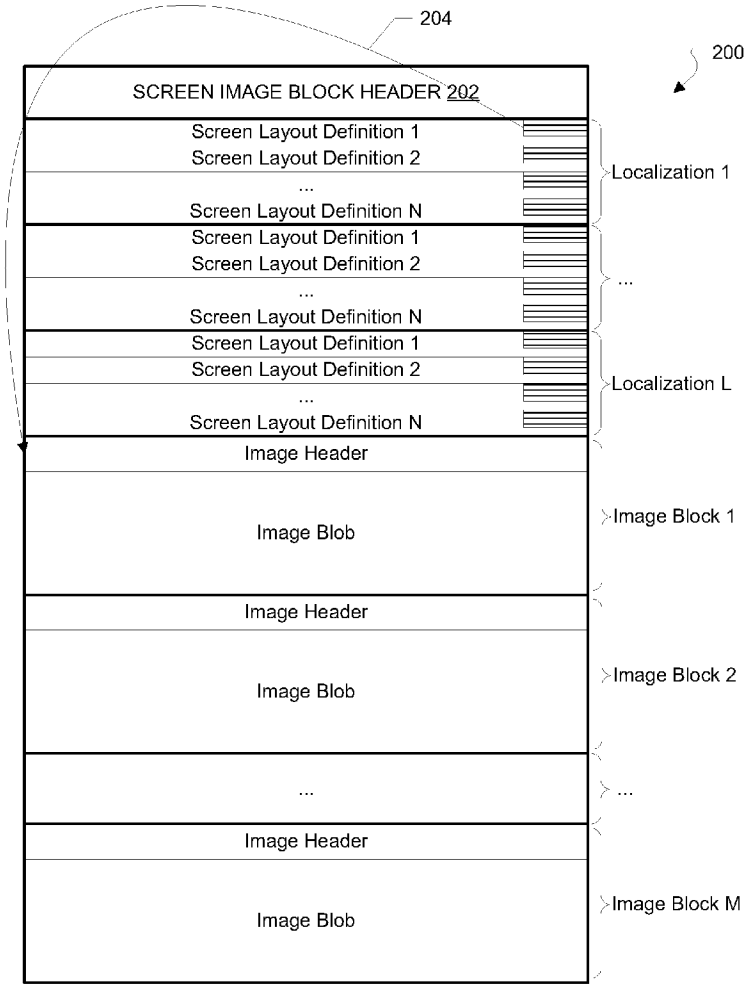
FIG. 2 illustrates an example configuration of the data structure of screen image block.

FIG. 2 illustrates an example configuration of the data structure of a screen image block. Screen image block 200 can be stored in binary form in system firmware. Screen image block 200 can contain several images, as well as screen layout definitions for constructing screen layouts. During the boot strap process, the system firmware can generate a specified screen layout by rendering a screen image using screen image block 200.

In the example of FIG. 2, screen image block 200 includes a screen image block header 202, and localizations 1 through L, with each localization including screen layout definitions 1 to N. In addition, screen image block 200 includes image blocks 1 to M, each of which includes an image header and an image blob. The image header can provide attributes about the image blob. The image blob can correspond to the actual pixels to be shown on a screen. As such, the example of FIG. 2 can account for L localizations, N screen layouts per localization, and M images that can be used to generate a particular screen layout.

Screen image block header 202 can define the number of localizations, the number of screen layouts per localization, and the number of images that can be used to generate a screen layout. Screen image block header 202 can further define a maximum allowable number of images. In addition, screen image block header 202 can include a checksum to validate the integrity of a screen layout definition (e.g., screen layout definitions 1 to N) and the plurality of images (e.g., image blocks 1 to M).

Localization can refer to the process of modifying software and translating text so that it is more suited for a specific locale (e.g., a specific area and/or language). In the context of the subject disclosure, localization can refer to translating text and modifying the BIOS display for a specific locale. In the example of FIG. 2, each of localizations 1 to L can correspond to a different area/language, with each localization including a number of screen layouts specific to the area/language.

During the bootstrap process, the BIOS may allow for a user to select between different localizations. For example, if the user presses a certain key (e.g., the right arrow key) on the keyboard of a computing system, the BIOS may switch from one localization (e.g., using the English language) to another localization (e.g., using the Japanese language). Each localization can provide for a different configuration of images (e.g., messages/icons specific to the locale) to generate one of several screen layouts. In this regard, the number of screen layout definitions per localization may be the same.

Each screen layout definition can be used to generate a different screen, composed of a number of images overlaid in a certain order and position. More particularly, each of screen layout definitions 1 to N can define how to overlay certain images for a particular screen. Each screen layout definition may define x and y-coordinates for the overall screen image to be rendered. For example, the x and y-coordinates may be used to set the resolution for the screen.

Screen layout definitions 1 to N may further include an offset from the start of screen image block 200 indicating where image data starts. For example, arrow 204 in FIG. 2 illustrates that an offset contained in screen layout definition 1 of localization 1 can be employed to access image blocks 1 to M.

In addition, screen layout definitions 1 to N can include an array of image information (hereinafter "image array"). The image array can identify which images to include for the screen layout, can define an order for overlaying the identified images, and can define a position (e.g., using x and y-coordinates) for placing each image within the screen layout. Regarding the order for overlaying, an indexing order of the image array can define the order for overlaying images. For example, the first entry of the array can identify the first image and position of the first image within the screen layout, the second entry can identify the second image and position within the screen layout, and so on. Although the use of an array is described above, it should be noted that another type of data structure corresponding to an ordered sequence can instead be used.

Furthermore, the first image may be a base image, which is selected to set the resolution for the screen. The base image can match the desired or default display resolution, allowing for any previous screen to be cleared on the display. As such, the first (or base) image may be the largest image used in generating a particular screen.

With reference to image blocks 1 to M of screen image block 200, each image block can include an image header including attributes about the image. For example, these image attributes can include a tag indicating a special image (e.g., indicating that the image is a hardware ID (HWID) image), an image width, an image height, a file format, a compression method, a size of the uncompressed image, a size of the compressed image, and any other information about the image. It should be noted that the image data itself may contain enough information for display of the image. Thus, inclusion of the image attributes in the image header may not be required, but can be used for added convenience.

In addition to an image header, each of image blocks 1 to M can include an image blob corresponding to the actual pixels to be shown on a screen. The image blobs correspond to the plurality of images which can be combined form a screen layout. For example, the image blobs can correspond to large portions of a screen layout (e.g., base images), messages for display (e.g., URLs, model numbers, text instructions), icons for display, other graphical elements for display, or any portion or combination of the foregoing.

It is possible that different modes can be set for the BIOS. For example, the BIOS can include a normal mode, a recovery mode and a developer mode. The normal mode can refer to a successful boot operation from an internal disk (e.g., a solid-state drive (SSD)). It is possible that no screen layouts are displayed in normal mode. It is also possible that the BIOS displays status messages informing the user of processes occurring during bootup in normal mode.

Recovery mode can refer to a special boot operation in which the BIOS refuses to boot from an internal disk (e.g., the SSD), prompts the user to insert a recovery device (e.g., a USB drive or a secure digital multimedia (SD/MMC) card), and boots an authenticated BIOS image from the recovery device. For example, the recovery mode may apply when the BIOS is unable to find a valid kernel to boot (e.g., because the internal drive has become corrupted). In recovery mode, it is possible for the BIOS to display messages with details of the status of the boot operation.

Developer mode can refer to a mode in which the user selects an operating system other than the default operating system. This mode can be enabled by a switch (e.g., a hardware switch) on the computing device. To prevent a user from enabling developer mode without his/her knowledge, whenever the switch for developer mode is enabled, it is possible for the BIOS to display a warning and an option for the user to boot from normal mode or recovery mode instead of developer mode.

While normal, recovery and developer modes are mentioned herein, it is possible that different modes can be set for the BIOS. As such, the generation of screen layouts for a BIOS display as discussed herein can apply to normal, recovery and developer modes, as well as any other BIOS mode.

Figure 3:
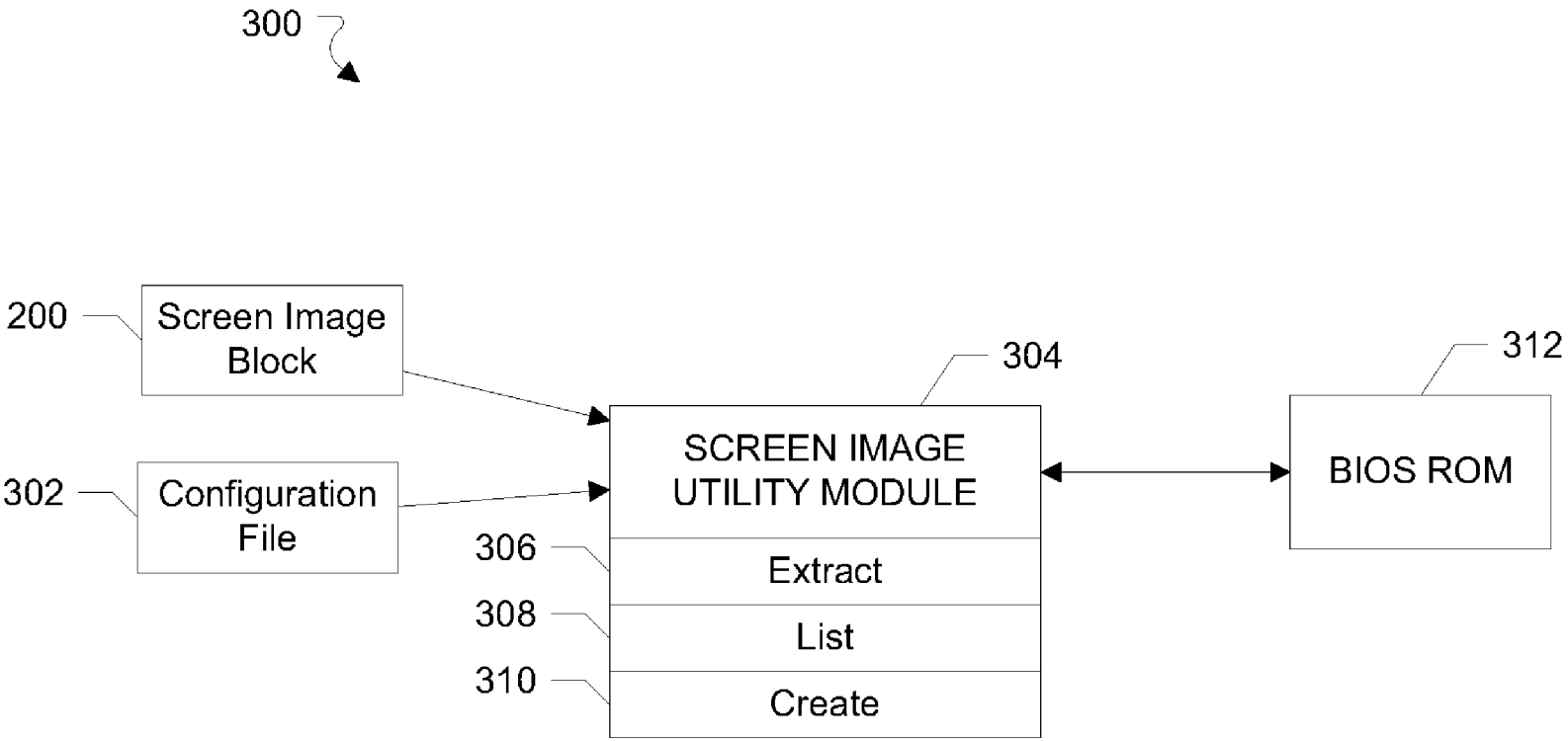
FIG. 3 illustrates an example screen image block utility module which includes components for generating a screen layout for a BIOS display on a computing system.

FIG. 3 illustrates an example screen image block utility module which includes components for generating a screen layout for a BIOS display on a computing system. BIOS ROM 312 can correspond to a ROM image of the BIOS containing the main BIOS code. The main BIOS code establishes the basic interfaces for a computer processor and enables the processor to bootstrap the operating system. However, the main BIOS code may call upon various modules when performing these functions. For example, the BIOS code can search BIOS ROM 312 for a compressed screen image utility module 304, expand it into random-access memory (RAM), and store a pointer to it. The BIOS code can call upon screen image utility module 304 located at the stored pointer to generate various screen layouts for BIOS display.

To generate the various screens during bootup, screen image utility module 304 may access a screen image block (e.g. screen image block 200 of FIG. 2). As described above, screen image block 200 can contain several images for BIOS display, as well as the screen layout definitions defining an order and position of the separate images for a given screen layout.

Screen image utility module 304 may include logic to access various sub-modules, which can be used in generating the various screens displayed by the BIOS. For example, these sub-modules can include an extract module 306, a list module 308 and a create module 310. Extract module 306 can be used to extract image data from screen image block 200 for BIOS display. List module 308 can be used to list the contents of screen image block 200. Create module 310 can be used to create an image block, such as screen image block 200, for storage in firmware and use in future BIOS display.

Create module 310 may create an image block by accessing a configuration file 302. Configuration file may define localizations, the screen layouts within localizations, and the image files used for the screen layouts. Before creating an image block, create module 306 may ensure that the configuration file is valid. For example, create module 310 may check that every specified image file (e.g., bitmap file) exists, corresponds to an image file, and has appropriate dimensions. Create module 310 can further check that every localization has the same number of screens, every image is referenced somewhere in the screens, every screen is referenced somewhere in the localizations, and that none of the screens have too many images. Create module 310 can further check whether the dimensions of the first image (e.g., base image) in each screen fully contain all the other dimensions, and that the compression mode is appropriate for the target platform.

Figure 4:
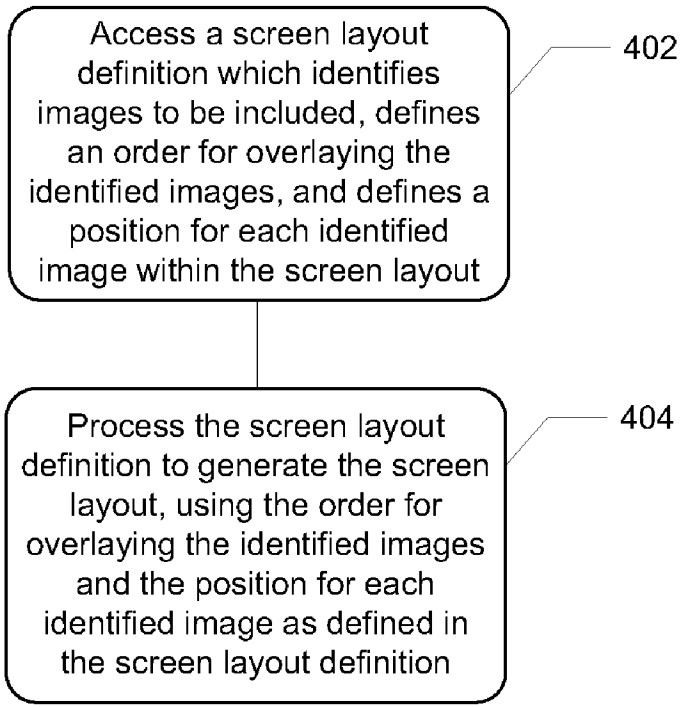
FIG. 4 illustrates a process by which a screen layout is generated for a BIOS display on a computing system.

FIG. 4 illustrates a process by which a BIOS display is generated. At block 402, a screen layout definition is accessed. The screen layout definition identifies which of a plurality of stored images are to be included in a screen layout, defines an order for overlaying the identified images, and defines a position for placing for each identified image within the screen layout.

A data structure (e.g., screen image block 200) can store both the screen layout definition and the plurality of images. The data structure can store the plurality of images as separate image blocks, with each image block including one of the plurality of images and a corresponding image header defining attributes for the one image. Each image header can define attributes including an image width, an image height, a file format, a compression method, a size of the uncompressed image and a size of the compressed image.

The data structure can also store a plurality of screen layout definitions. As such, a selection can be made as to which one of the plurality of screen layout definitions to access, based on a state of a bootstrap process on the computing system. The data structure can also include a checksum to validate the integrity of the screen layout definition and the plurality of images. The data structure can also store a plurality of localizations, each localization defining one or more screen layout definitions for a specific locale.

The screen layout definition can include an ordered sequence. An indexing order of the ordered sequence can define the order for overlaying the identified images. The entries of the ordered sequence can identify which of the plurality of images are to be included in the screen layout. The entries of the ordered sequence can also define the position for each identified image within the screen layout.

A first image in the order of identified images can be a base image, which sets a display resolution for the screen layout and corresponds to the largest image in the plurality of images. Each of the plurality of images can correspond to a bitmap.

At step 404, the screen layout definition is processed to generate the screen layout, using the order for overlaying the identified images and the position for each identified image as defined in the screen layout definition for display.

The screen layout can be generated within a recovery mode, which corresponds to a BIOS failure in bootstrapping the operating system from an internal disk (e.g., an SSD), thereby prompting insertion of a recovery device by a user, and booting an authenticated image from the recovery device. For example, the recovery device can correspond to a USB drive or an SD/MMC card. The screen layout can also be generated within a developer mode, which corresponds to a user selection to bootstrap with an operating system other than a default operating system.

Many of the above-described features and applications are implemented as software processes that are specified as a set of instructions recorded on a computer readable storage medium (also referred to as computer readable medium). When these instructions are executed by one or more processing unit(s) (e.g., one or more processors, cores of processors, or other processing units), they cause the processing unit(s) to perform the actions indicated in the instructions. Examples of computer readable media include, but are not limited to, CD-ROMs, flash drives, RAM chips, hard drives, EPROMs, etc. The computer readable media does not include carrier waves and electronic signals passing wirelessly or over wired connections.

In this specification, the term "software" is meant to include firmware residing in read-only memory or applications stored in magnetic storage, which can be read into memory for processing by a processor. Also, in some implementations, multiple software aspects of the subject disclosure can be implemented as sub-parts of a larger program while remaining distinct software aspects of the subject disclosure. In some implementations, multiple software aspects can also be implemented as separate programs. Finally, any combination of separate programs that together implement a software aspect described here is within the scope of the subject disclosure. In some implementations, the software programs, when installed to operate on one or more electronic systems, define one or more specific machine implementations that execute and perform the operations of the software programs.

A computer program (also known as a program, software, software application, script, or code) can be written in any form of programming language, including compiled or interpreted languages, declarative or procedural languages, and it can be deployed in any form, including as a stand alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

Figure 5:
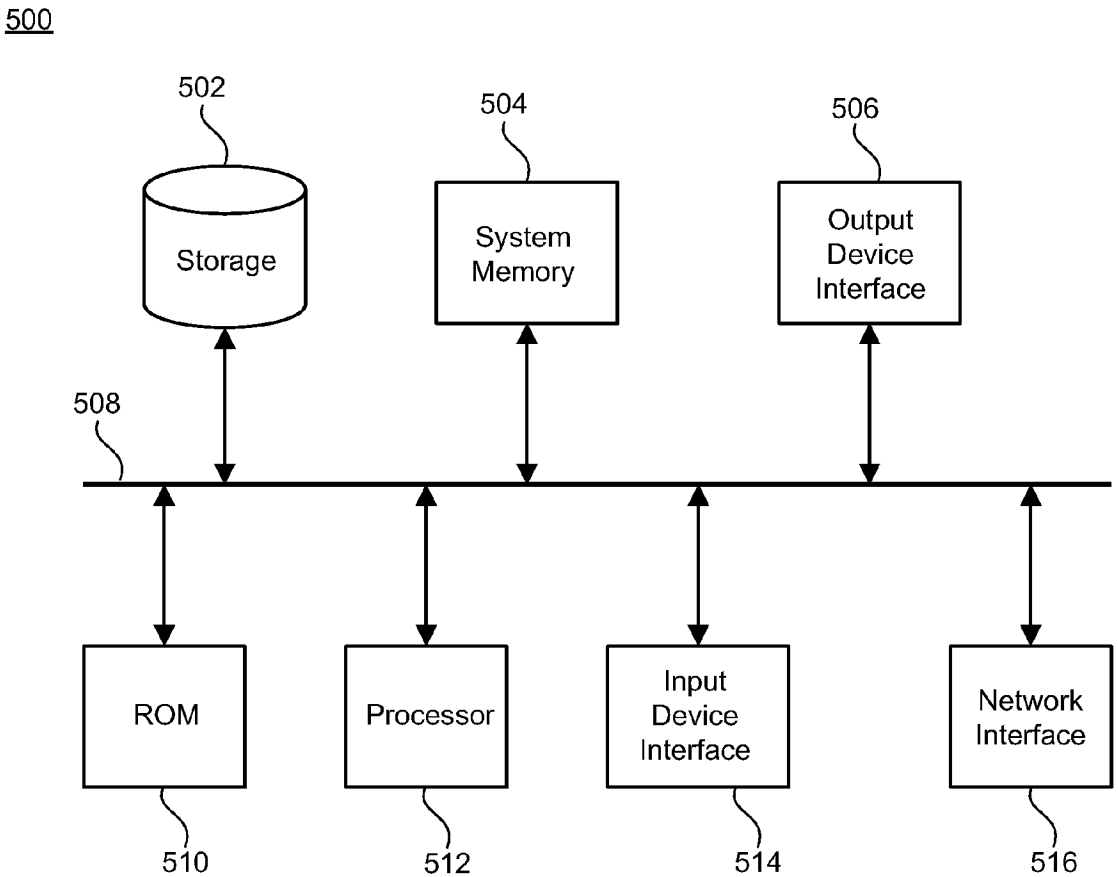
FIG. 5 conceptually illustrates an electronic system with which some implementations of the subject technology are implemented.

FIG. 5 conceptually illustrates an electronic system with which some implementations of the subject technology are implemented. Electronic system 500 can be a computer, phone, PDA, or any other sort of electronic device. Such an electronic system includes various types of computer readable media and interfaces for various other types of computer readable media. Electronic system 500 includes a bus 508, processing unit(s) 512, a system memory 504, a read-only memory (ROM) 510, a permanent storage device 502, an input device interface 514, an output device interface 506, and a network interface 516.

Bus 508 collectively represents all system, peripheral, and chipset buses that communicatively connect the numerous internal devices of electronic system 500. For instance, bus 508 communicatively connects processing unit(s) 512 with ROM 510, system memory 504, and permanent storage device 502.

From these various memory units, processing unit(s) 512 retrieves instructions to execute and data to process in order to execute the processes of the subject disclosure. The processing unit(s) can be a single processor or a multi-core processor in different implementations.

ROM 510 stores static data and instructions that are needed by processing unit(s) 512 and other modules of the electronic system. For example, ROM 510 can store BIOS ROM 312 and screen utility module 304 of FIG. 3. In addition, ROM 510 can store screen image block 200 and configuration file 302.

Permanent storage device 502, on the other hand, is a read-and-write memory device. This device is a non-volatile memory unit that stores instructions and data even when electronic system 500 is off. Some implementations of the subject disclosure use a mass-storage device (such as a magnetic or optical disk and its corresponding disk drive) as permanent storage device 502.

Other implementations use a removable storage device (such as a floppy disk, flash drive, and its corresponding disk drive) as permanent storage device 502. Like permanent storage device 502, system memory 504 is a read-and-write memory device. However, unlike storage device 502, system memory 504 is a volatile read-and-write memory, such a random access memory. System memory 504 stores some of the instructions and data that the processor needs at runtime. In some implementations, the processes of the subject disclosure are stored in system memory 504, permanent storage device 502, and/or ROM 510. For example, the various memory units include instructions for processing image data in accordance with some implementations. From these various memory units, processing unit(s) 512 retrieves instructions to execute and data to process in order to execute the processes of some implementations.

Bus 508 also connects to input and output device interfaces 514 and 506. Input device interface 514 enables the user to communicate information and select commands to the electronic system. Input devices used with input device interface 514 include, for example, alphanumeric keyboards and pointing devices (also called "cursor control devices"). Output device interfaces 506 enables, for example, the display of images generated by the electronic system 500. Output devices used with output device interface 506 include, for example, printers and display devices, such as cathode ray tubes (CRT) or liquid crystal displays (LCD). Some implementations include devices such as a touchscreen that functions as both input and output devices.

Finally, as shown in FIG. 5, bus 508 also couples electronic system 500 to a network (not shown) through a network interface 516. In this manner, the computer can be a part of a network of computers (such as a local area network ("LAN"), a wide area network ("WAN"), or an Intranet, or a network of networks, such as the Internet. Any or all components of electronic system 500 can be used in conjunction with the subject disclosure.

These functions described above can be implemented in digital electronic circuitry, in computer software, firmware or hardware. The techniques can be implemented using one or more computer program products. Programmable processors and computers can be included in or packaged as mobile devices. The processes and logic flows can be performed by one or more programmable processors and by one or more programmable logic circuitry. General and special purpose computing devices and storage devices can be interconnected through communication networks.

Some implementations include electronic components, such as microprocessors, storage and memory that store computer program instructions in a machine-readable or computer-readable medium (alternatively referred to as computer-readable storage media, machine-readable media, or machine-readable storage media). Some examples of such computer-readable media include RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD–RW, DVD+RW, etc.), flash memory (e.g., SD cards, mini-SD cards, micro-SD cards, etc.), magnetic and/or solid state hard drives, read-only and recordable Blu-Ray® discs, ultra density optical discs, any other optical or magnetic media, and floppy disks. The computer-readable media can store a computer program that is executable by at least one processing unit and includes sets of instructions for performing various operations. Examples of computer programs or computer code include machine code, such as is produced by a compiler, and files including higher-level code that are executed by a computer, an electronic component, or a microprocessor using an interpreter.

While the above discussion primarily refers to microprocessor or multi-core processors that execute software, some implementations are performed by one or more integrated circuits, such as application specific integrated circuits (ASICs) or field programmable gate arrays (FPGAs). In some implementations, such integrated circuits execute instructions that are stored on the circuit itself.

As used in this specification and any claims of this application, the terms "computer", "server", "processor", and "memory" all refer to electronic or other technological devices. These terms exclude people or groups of people. For the purposes of the specification, the terms display or displaying means displaying on an electronic device. As used in this specification and any claims of this application, the terms "computer readable medium" and "computer readable media" are entirely restricted to tangible, physical objects that store information in a form that is readable by a computer. These terms exclude any wireless signals, wired download signals, and any other ephemeral signals.

To provide for interaction with a user, implementations of the subject matter described in this specification can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

Embodiments of the subject matter described in this specification can be implemented in a computing system that includes a back end component, e.g., as a data server, or that includes a middleware component, e.g., an application server, or that includes a front end component, e.g., a client computer having a graphical user interface or a Web browser through which a user can interact with an implementation of the subject matter described in this specification, or any combination of one or more such back end, middleware, or front end components. The components of the system can be interconnected by any form or medium of digital data communication, e.g., a communication network. Examples of communication networks include a local area network ("LAN") and a wide area network ("WAN"), an inter-network (e.g., the Internet), and peer-to-peer networks (e.g., ad hoc peer-to-peer networks).

The computing system can include clients and servers. A client and server are generally remote from each other and typically interact through a communication network. The relationship of client and server arises by virtue of computer programs running on the respective computers and having a client-server relationship to each other. In some embodiments, a server transmits data (e.g., an HTML page) to a client device (e.g., for purposes of displaying data to and receiving user input from a user interacting with the client device). Data generated at the client device (e.g., a result of the user interaction) can be received from the client device at the server.

It is understood that any specific order or hierarchy of steps in the processes disclosed is an illustration of exemplary approaches. Based upon design preferences, it is understood that the specific order or hierarchy of steps in the processes may be rearranged, or that all illustrated steps be performed. Some of the steps may be performed simultaneously. For example, in certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject disclosure.

A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as a "configuration" does not imply that such configuration is essential to the subject technology or that such configuration applies to all configurations of the subject technology. A disclosure relating to a configuration may apply to all configurations, or one or more configurations. A phrase such as a configuration may refer to one or more configurations and vice versa.

The word "exemplary" is used herein to mean "serving as an example or illustration." Any aspect or design described herein as "exemplary" is not necessarily to be construed as preferred or advantageous over other aspects or designs.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims.

What is claimed is:

1. A method of generating a screen layout for a BIOS display on a computing system, the method comprising:

accessing a screen layout definition, wherein the screen layout definition identifies which of a plurality of stored images are to be included in a screen layout, defines an order for overlaying the identified images, and defines a position for placing each identified image within the screen layout; and processing the screen layout definition to generate the screen layout, using the order for overlaying the identified images and the position for placing each identified image as defined in the screen layout definition, for the BIOS display, wherein a first image in the order for overlaying the identified images is a base image, which sets a display resolution for the screen layout and corresponds to the largest image in the plurality of images.

2. The method of claim 1, wherein a data structure stores both the screen layout definition and the plurality of images.

3. The method of claim 2, wherein the data structure stores the plurality of images as separate image blocks, each image block comprising one of the plurality of images and a corresponding image header defining attributes for the one image.

4. The method of claim 3, wherein each image header defines attributes including an image width, an image height, a file format, a compression method, a size of the uncompressed image and a size of the compressed image.

5. The method of claim 2, wherein the data structure stores a plurality of screen layout definitions, the method further comprising:

selecting one of the plurality of screen layout definitions to access, based on a state of a bootstrap process on the computing system.

6. The method of claim 2, wherein the data structure comprises a checksum to validate the integrity of the screen layout definition and the plurality of images.

7. The method of claim 2, wherein the data structure further stores a plurality of localizations, each localization defining one or more screen layout definitions for a specific locale.

8. The method of claim 1, wherein the screen layout definition comprises an ordered sequence, wherein an indexing order of the ordered sequence defines the order for overlaying the identified images, the entries of the ordered sequence identify which of the plurality of images are to be included in the screen layout, and the entries of the ordered sequence define the position for each identified image within the screen layout.

9. The method of claim 1, wherein each of the plurality of images corresponds to a bitmap.

10. The method of claim 1, wherein the screen layout is generated within a recovery mode, wherein the recovery mode corresponds to a BIOS failure in bootstrapping the operating system from an internal disk, thereby prompting insertion of a recovery device by a user, and booting an authenticated image from the recovery device.

11. The method of claim 1, wherein the screen layout is generated within a developer mode, wherein the developer mode corresponds to a user selection to bootstrap with an operating system other than a default operating system.

12. A system for generating a screen layout for a BIOS display on a computing system, the system comprising:

one or more processors; and a machine-readable medium comprising instructions stored therein, which when executed by the processors, cause the processors to perform operations comprising:

accessing a data structure which stores a screen layout definition and a plurality of images, wherein the screen layout definition identifies which of the plurality of images are to be included in a screen layout, defines an order for overlaying the identified images, and defines a position for placing each identified image within the screen layout; and processing the screen layout definition to generate the screen layout, using the order for overlaying the identified images and the position for placing each identified image as defined in the screen layout definition, for the BIOS display, wherein a first image in the order for overlaying the identified images is a base image, which sets a display resolution for the screen layout and corresponds to the largest image in the plurality of images.

13. The system of claim 12, wherein the data structure stores the plurality of images as separate image blocks, each image block comprising one of the plurality of images and a corresponding image header defining attributes for the one image.

14. The system of claim 12, wherein each image header defines attributes including an image width, an image height, a file format, a compression method, a size of the uncompressed image and a size of the compressed image.

15. The system of claim 12, wherein the data structure stores a plurality of screen layout definitions, the processors performing operations further comprising:

selecting one of the plurality of screen layout definitions to access, based on a state of a bootstrap process on the computing system.

16. The system of claim 12, wherein the data structure comprises a checksum to validate the integrity of the screen layout definition and the plurality of images.

17. The system of claim 12, wherein the data structure further stores a plurality of localizations, each localization defining one or more screen layout definitions for a specific locale.

18. The system of claim 12, wherein the screen layout definition comprises an ordered sequence, wherein an indexing order of the ordered sequence defines the order for overlaying the identified images, the entries of the ordered sequence identify which of the plurality of images are to be included in the screen layout, and the entries of the ordered sequence define the position for each identified image within the screen layout.

19. A machine-readable medium comprising instructions stored therein, which when executed by a machine, cause the machine to perform operations comprising:

accessing a data structure which stores a plurality of screen layout definitions and a plurality of images, wherein each screen layout definition identifies which of the plurality of images are to be included in a corresponding screen layout, defines an order for overlaying the identified images, and defines a position for placing each identified image within the screen layout, and wherein the data structure stores the plurality of images as separate image blocks, each image block comprising one of the plurality of images and a corresponding image header defining attributes of the one image;

selecting, based on a state of a bootstrap process of the machine, one of the plurality of screen layout definitions to apply; and processing, using the order for overlaying the identified images and the position for placing each identified image as defined in the screen layout definition, the screen layout definition to generate the screen layout, for a BIOS display, wherein a first image in the order for overlaying the identified images is a base image, which sets a display resolution for the screen layout and corresponds to the largest image in the plurality of images.

* * * * *